United States Patent [19]

Castronovo, Jr.

[11] Patent Number: 4,916,765

[45] Date of Patent: Apr. 17, 1990

[54] PILLOW KIT

[75] Inventor: Joseph A. Castronovo, Jr., Miami, Fla.

[73] Assignee: Florifoam, Inc., Miami, Fla.

[21] Appl. No.: 380,383

[22] Filed: Jul. 17, 1989

[51] Int. Cl.[4] ..... A47C 20/00

[52] U.S. Cl. ..... 5/437; 5/432; 5/442

[58] Field of Search ..... 5/431, 432, 434–437, 5/440, 441, 446, 447, 462

[56] References Cited

U.S. PATENT DOCUMENTS

| | | | |
|---|---|---|---|
| 3,243,828 | 4/1966 | McCarty | 5/447 X |
| 3,601,121 | 8/1971 | Roberts | 128/33 |
| 3,719,185 | 3/1973 | Hanes | 128/69 |
| 3,974,532 | 8/1976 | Ecchuya . | |
| 4,320,543 | 3/1982 | Dixon | 5/434 |
| 4,682,818 | 8/1987 | Morell | 5/437 X |
| 4,748,702 | 6/1988 | Sandler | 5/434 |
| 4,759,089 | 7/1988 | Fox | 5/434 |
| 4,777,855 | 10/1988 | Cohen | 5/434 X |
| 4,803,743 | 2/1989 | Greenawalt | 5/436 X |
| 4,810,034 | 3/1989 | Beier | 5/447 X |

FOREIGN PATENT DOCUMENTS

| | | | |
|---|---|---|---|
| 999217 | 7/1965 | United Kingdom | 5/434 |

OTHER PUBLICATIONS 1988 brochure of Core Products International.

*Primary Examiner*—Michael F. Trettel
*Attorney, Agent, or Firm*—Oltman and Flynn

[57] ABSTRACT

A pillow kit including a compressible and resilient cushion body have a recess therein extending across its complete width and a narrow opening extending into the recess from the outside of the cushion body, and a plurality of compressible and resilient inserts that are snugly receivable one at a time in that recess. The inserts have different degrees of stiffness.

7 Claims, 3 Drawing Sheets

8
49
43
45
48
46
41
9
51
44
40
42
R
52
41
50
L
8

43
45
47
9
46
41
48
44
50
42

51
R
45
52
43
L
49
41
46
48
44
42

B-C OR D
48

46
44
48
51
52
41
50
49
R
L

PILLOW KIT

SUMMARY OF THE INVENTION

This invention relates to a pillow kit which enables a user to choose the degree of firmness of a critical area of the pillow by selecting among different inserts for that area.

Different persons tend to have individual preferences as to softness for both head pillows and back pillows. In addition, an individual may have different preferences at different times, often depending upon how the pillow is to be used. For example, at times a person may want to use a head pillow that acts to hold the sleeper's head straight; at other times not. Also, for use in a car a person may want a stiffer back pillow compared to one for use in a chair at home. Therefore, it is advantageous that a person be able to select and, if desired, to change the compressibility characteristics of a pillow.

The present invention enables this by providing a pillow kit which includes a plurality of inserts with different degrees of stiffness for reception individually in a corresponding recess in a cushion body.

Therefore, a principal object of this invention is to provide a novel pillow kit with a plurality of selectively used inserts for imparting a desired degree of stiffness to a critical area of a cushion.

Further objects and advantages of this invention will be apparent from the following detailed description of three presently preferred embodiments which are illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
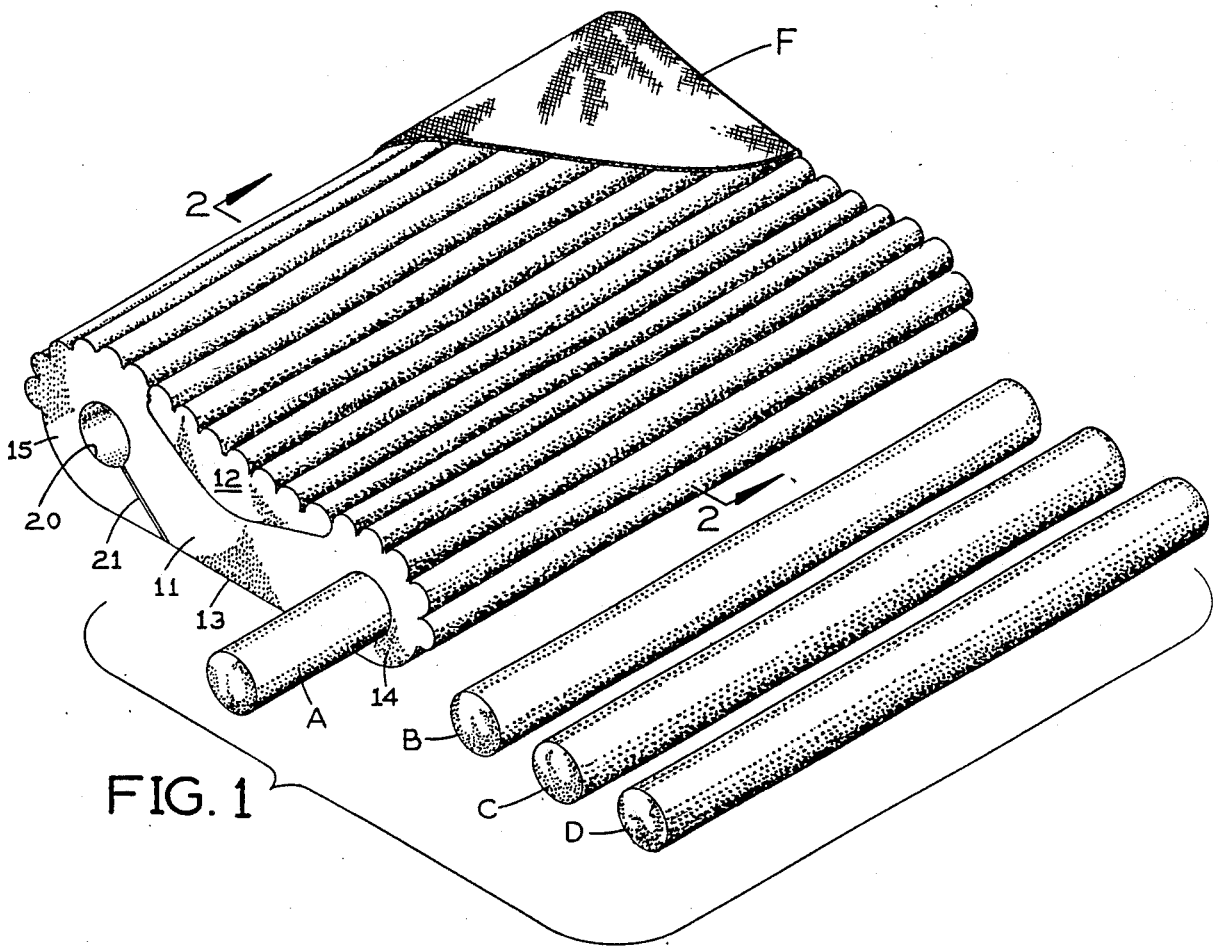
FIG. 1 is an exploded perspective view showing a pillow kit in accordance with a first embodiment of the present invention.
Figure 2:
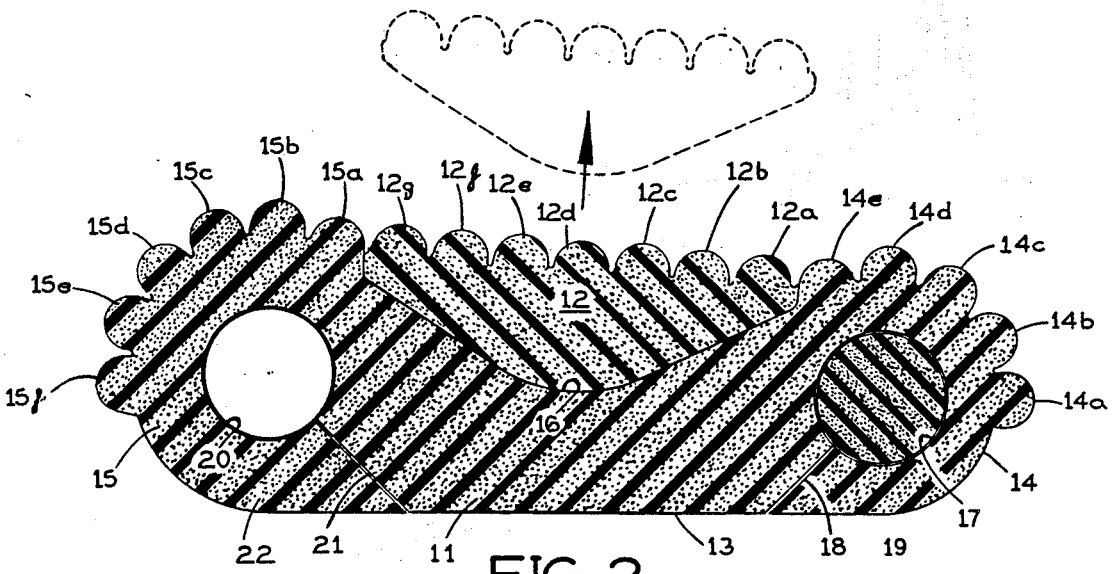
FIG. 2 is a vertical longitudinal section taken along the line 2—2 in FIG. 1 with two inserts in place in the cushion body.

Referring to FIGS. 1 and 2, the first embodiment of the present pillow kit comprises a cushion body 11, a removable top piece 12 for the pillow body, four cylindrical inserts A,B,C and D, a selected pair of which are received singly in the pillow body near the front and back, respectively, and a fabric cover F on the outside.

The cushion body 11 has a flat bottom face 13, a rounded front lobe 14 extending up from the front end of the bottom face, a rounder rear lobe 15 extending up from the back end of the bottom face, and an approximately V-shaped, shallow trough 16 on top between the front and rear lobes 14 and 15 across the complete width of the cushion body from side to side. The front lobe 14 of the cushion body presents outwardly protruding, rounded ridges **14*a*, 14*b*, 14*c*, 14*d* and 14*e* in close succession from front to back, separated by narrow grooves. These ridges and grooves extend across the complete width of the cushion body from side to side. The rear lobe 15 presents similar ridges 15*a*, 15*b*, 15*c*, 15*d*, 15*e* and 15*f*** and grooves.

The top piece 12 is shaped and dimensioned to fit snugly in the trough 16 in cushion body 11 between the rear-most ridge **14*e* on its front lobe 14 and the forward-most ridge 15*a* on its rear lobe 15. The top piece 12 from front to back on top presents a series of rounded ridges 12*a*, 12*b*, 12*c*, 12*d*, 12*e*, 12*f* and 12*g* separated by narrow grooves. The rounded tops of these ridges 12*a*–12*g* are substantially coplanar with the rounded tops of the rear-most ridge 14*e* on front lobe 14 and the forward-most ridge 15*a* on rear lobe 15 of pillow body 11**.

Depending upon how the pillow is to be used, the top piece 12 may be removed from the pillow kit, as indicated in phantom in FIG. 2.

The cushion body 11 is of foamed plastic or foam rubber and it is soft, easily compressible and resilient. The top piece 12 is of similar material and it may have the same or different properties of compressibility and resilience as the pillow body.

The cushion body 11 is formed with a recess 17 extending centrally through its front lobe 14 from one side to the opposite side. In the particular embodiment shown, this recess is cylindrical. The cushion body has a narrow slit 18 which is inclined upward and forward from its bottom face 13 to the recess 17. Slit 18 extends completely across the cushion body from side to side. In front of this slot the cushion body presents a bottom front segment 19 that is joined to the lower end of its front lobe 14 and is readily flexible manually so that it can be easily pulled away from the cushion body behind this slit.

In accordance with the present invention, the pillow kit has a set of four inserts A,B,C and D, each of which is shaped and dimensioned to be snugly received in recess 17 in the cushion body 11. Preferably, the four inserts have different colors to make it easier to identify them individually. For a cylindrical recess 17, as shown each of these inserts is a complementary solid cylinder. The four inserts are of foamed plastic or foam rubber and they have differing degrees of compressibility. Preferably, insert A is the most easily compressible of the four, and may be the same compressibility as the pillow body. The inserts B,C and D are progressively more difficult to compress. Therefore, the user has a choice of four different degrees of stiffness of the insert for the front lobe 14 of the cushion body.

To insert or remove one of the inserts A,B,C or D, the bottom front segment 19 of the cushion body is pulled away from the cushion body behind slit 18, thereby effectively widening this slit so that the entire insert A,B,C or D can be easily placed in the recess along its full length from side to side across the cushion body. Friction between the insert and the cushion body would make it difficult to slide the insert into recess 17 from one side of the cushion body to the opposite side. After the insert is in place in recess 17, the bottom front segment 19 is released and it springs back to the position shown in FIG. 2.

The rear lobe 15 of cushion body 11 has a cylindrical recess 20 identical to the recess 17 in the front lobe 14. The cushion body has a narrow slit 21 extending upwardly and rearward from its bottom face to recess 20. Behind this slit the cushion body has a rear bottom segment 22 that is readily flexible, enabling it to be pulled away from the cushion body in front of slit 21 so that a remaining one of the inserts A,B,C and D can be put in recess 20. The rear lobe 15 may be slightly higher than the front lobe 14.

In one practical embodiment the cushion body 11 has an indentation load deflection (ILD) factor of 15, insert A has an ILD of 15. Insert B has an ILD of 38, insert C has an ILD of 60, and insert D has an ILD of 95. Thus, each of the inserts B,C and D is substantially stiffer than the cushion body 11. ILD is a numerical representation of the force it takes to indent the foam material a given amount.

Figure 4:
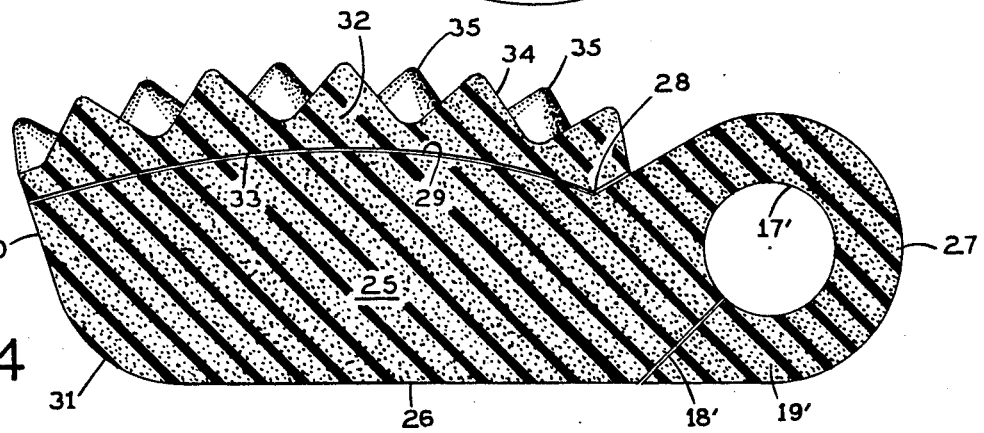
FIG. 4 is a section taken along the line 4—4 in FIG. 3.
Figure 5:
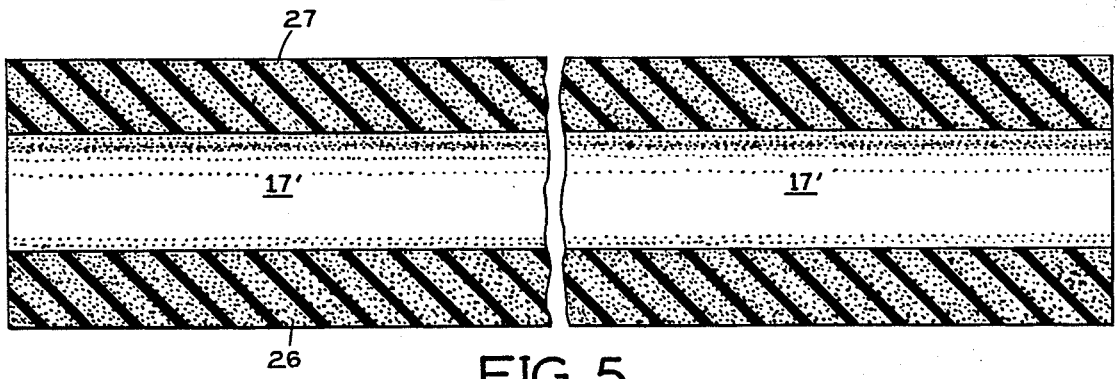
FIG. 5 is a cross-section taken along the line 5—5 in FIG. 3.
Figure 6:
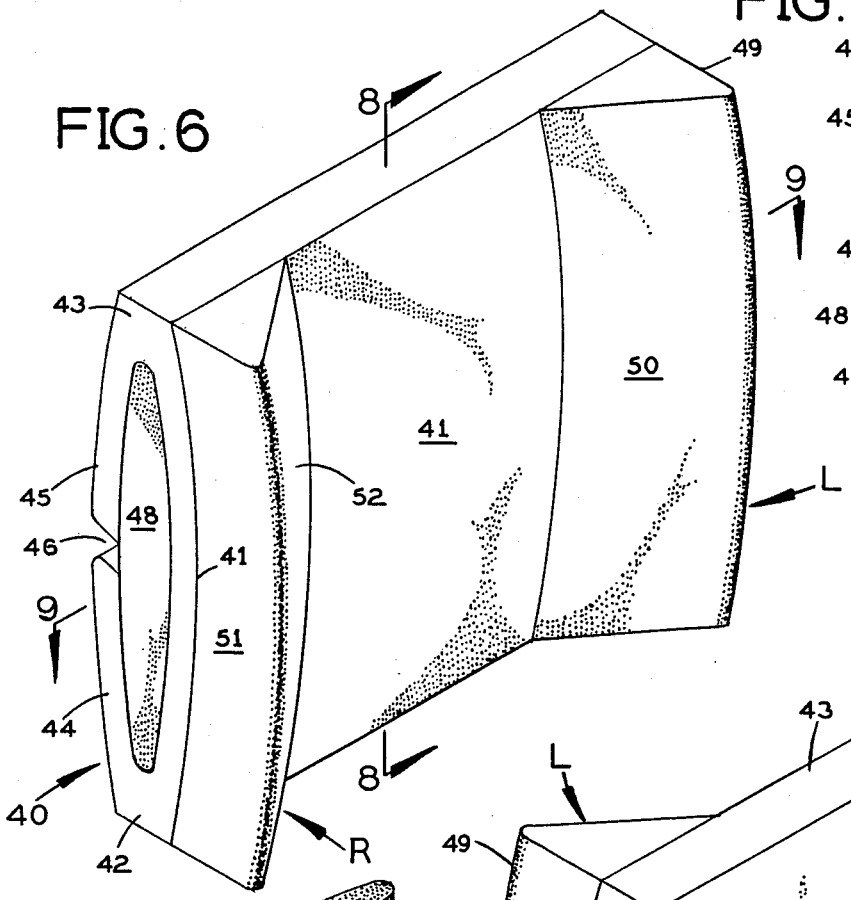
FIG. 6 is a front perspective view showing a back pillow kit in accordance with a third embodiment of this invention.
Figure 8:
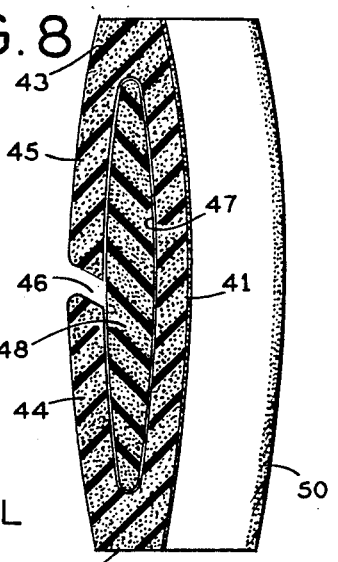
FIG. 8 is a vertical cross-section taken along the line 8—8 in FIG. 7.
Figure 7:
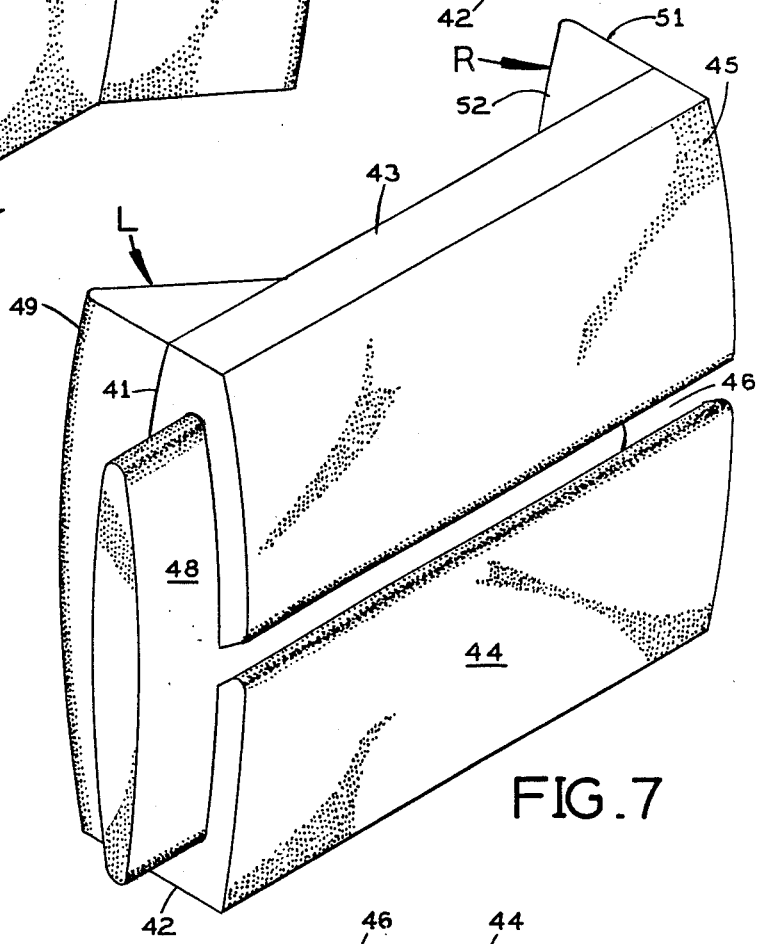
FIG. 7 is a rear perspective view of the FIG. 6 pillow kit with the insert partly inserted.
Figure 10:
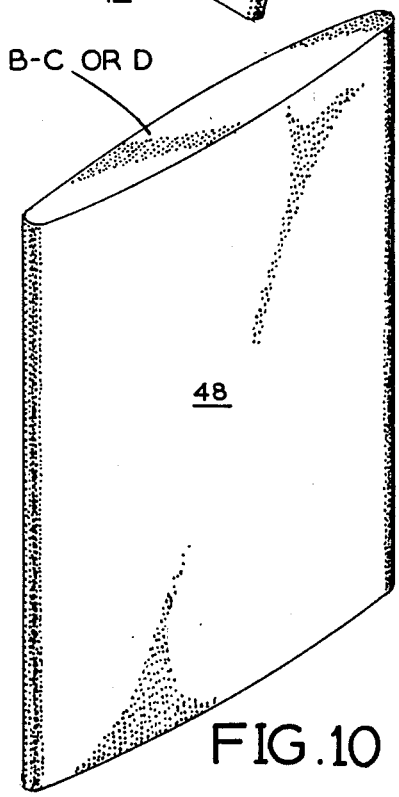
FIG. 10 is a perspective view of the insert in the pillow kit of FIGS. 6–8.
Figure 9:
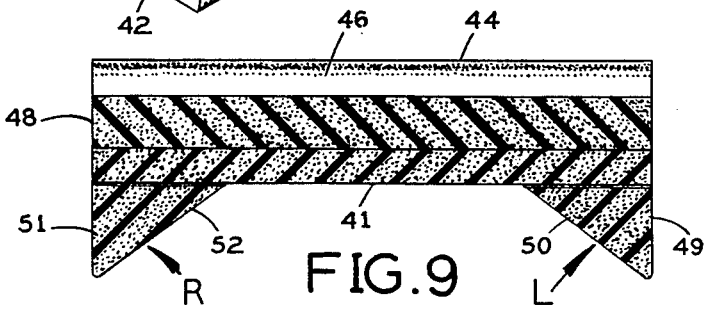
FIG. 9 is a horizontal cross-section taken along the line 9—9 in FIG. 7.

In the second embodiment of the invention (FIGS. 3–5) the cushion body 25 has a flat bottom face 26, a rounded front lobe 27 of substantially cylindrical configuration, a generally V-shaped, shallow trough 28 behind lobe 27 at the top of the cushion body, a convex top face 29 extending behind trough 28 to a flat, forwardly and downwardly inclined back face 30 of the cushion body, and a convex rear bottom corner 31 between the back face and the bottom face.

A top piece 32 overlies the convex top face 29 of the cushion body, presenting a concave bottom face 33 that matches the top face 29 and preferably is adhesively bonded to it. The top piece across its entire extent both longitudinally and laterally of the cushion body presents a plurality of upwardly projecting dome-shaped protrusions 34 with rounded tops 35 that lie substantially in a curved plane extending parallel to the convex top face 29 of the cushion body.

Figure 3:
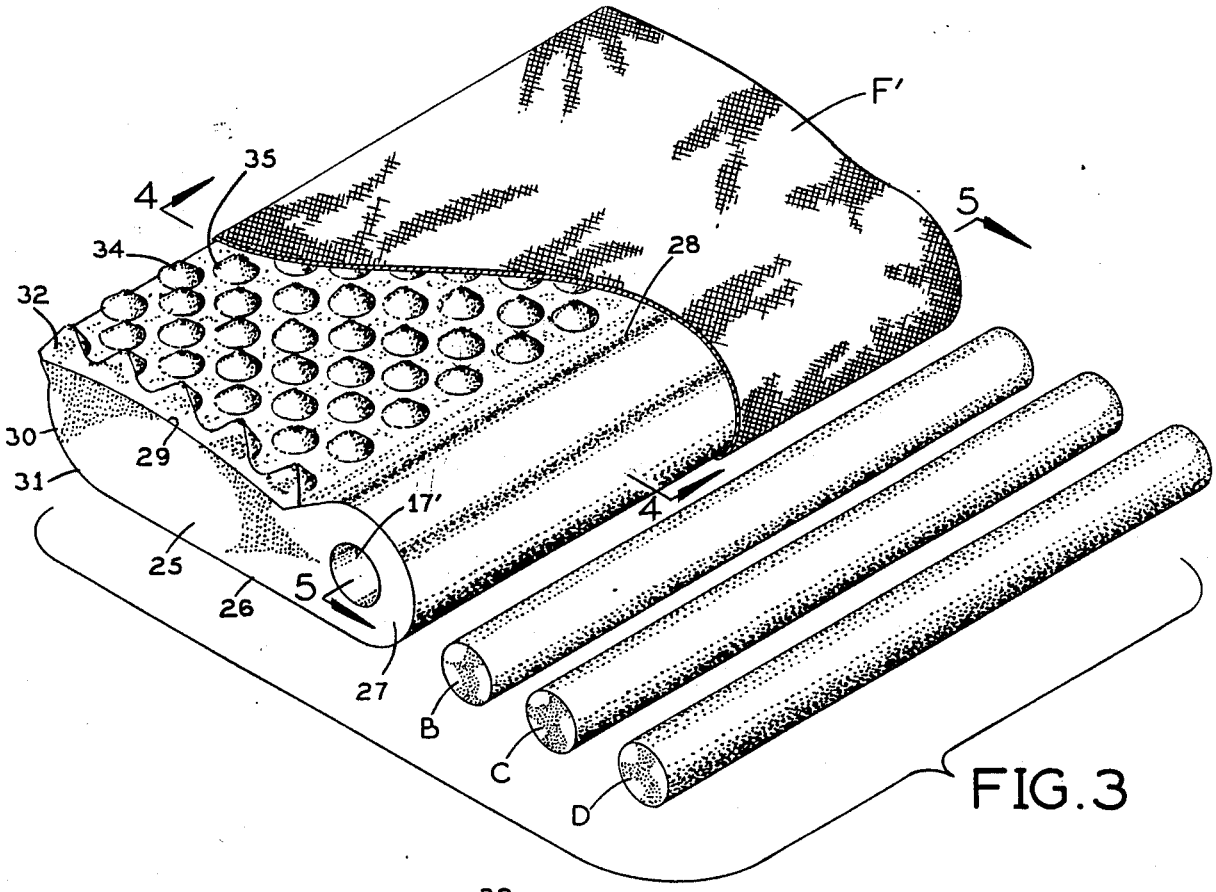
FIG. 3 is an exploded perspective view of a second embodiment of this invention.

The front lobe 27 of cushion body 25 has a cylindrical recess 17' like the recess 17 in the embodiment of FIGS. 1–3, a narrow slit 18' extending upward and forward from its bottom face 26 into recess 17' like the slit 18 in FIGS. 1–3, and a front bottom segment 19' like the front bottom segment 19 in FIGS. 1–3.

This pillow kit also includes a fabric cover F' snugly enclosing the cushion body 25 and top piece 32, and a set of three inserts B,C and D for selective insertion individually in recess 17' in the front lobe of the cushion body. These three inserts are identical to B,C and D in the embodiment of FIGS. 1–2, each having a compressibility different from the other two and different from the compressibility of the cushion body 25 and top piece 32. The cushion body and the top piece may have the same compressibility (ILD) and each of the inserts B,C and D preferably has a higher ILD (and therefore is stiffer) than the cushion body and top piece.

FIGS. 6–10 show a third embodiment of the invention in which the pillow kit is designed to fit behind the lower back of a person sitting down.

In this embodiment the foamed plastic or foam rubber cushion body 40 has a forwardly bowed front wall 41 extending up from a bottom segment 42 to a top segment 43, a lower rear segment 44 extending up from the bottom segment, and an upper rear segment 45 extending down from the top segment 43. The lower and upper rear segments 44 and 45 curve rearward from the bottom and top segments 42 and 43, respectively, and their neighboring free ends are separated by a slot or gap 46 extending from side to side across the full width of the cushion body.

The front segment 41 and the rear segments 44 and 45 of the cushion body define a recess 47 of oval cross-section which receives a complementary foamed plastic or foam rubber insert 48 having a higher ILD than the cushion body 40. The pillow kit has more than one such insert (e.g., four), each with a different compressibility than the others so that a person can selectively vary the overall stiffness of the pillow kit by the choice of insert. The lower and upper rear segments 44 and 45 of the cushion body are easily flexible manually so that they can be separated readily to permit the insertion of the insert 48 into recess 47 in the cushion body.

The pillow kit has side pieces L and R adhesively bonded to the front wall 41 of cushion body 40 and extending from top to bottom at the left and right sides, respectively. In horizontal cross-section, each of these side pieces is substantially a right triangle. The left side piece L presents a flat end face 49 that is coplanar with the left end face of cushion body 40 and an inclined front face 50 that extends from its end face 49 at an acute angle laterally inward to the front of the cushion body. The right side piece R is a mirror image of side piece L, with a flat end face 51 that is coplanar with the right end face of cushion body 40 and a front face 52 with an opposite inclination from that of the front face 50 of the left side piece L.

The pillow kit of FIGS. 6–10 preferably has a fabric cover (not shown) which closely conforms to the cushion body 40 and its side pieces L and R.

From the foregoing description and the drawings, it will be apparent that the present pillow kit with its multiple inserts is susceptible of various configurations capable of providing a selected degree of stiffness in an area of the pillow that is critical to the user's comfort.

I claim:

1. A pillow kit comprising:

a compressible and resilient body having a top and a bottom, a recess therein extending across the width of said body, and a narrow opening extending from the outside of said body into said recess along substantially the complete extent of said recess across the width of said body;

a set of compressible and resilient inserts shaped and dimensioned for snug reception one at a time in said recess, each of said inserts having a predetermined compressibility different from every other insert in said set;

said cushion body having a trough in said top;

and a compressible and resilient top piece substantially filling said trough and removably received therein.

2. A pillow kit according to claim 1 wherein:

said cushion body has a rounded front lobe thereon in front of said trough and a rounded rear lobe behind said trough, each of said lobes having a succession of closely spaced, outwardly protruding, rounded ridges, thereon;

and said top piece has a series of closely spaced, upwardly protruding, rounded ridges on the top in succession between said front and rear lobes.

3. A pillow kit according to claim 2 wherein:

said recess in said cushion body is in said front lobe;

said rear lobe has a recess therein extending across the width of said cushion body and shaped and dimensioned to snugly receive said inserts one at a time;

and said cushion body has a narrow opening therein extending from the outside of said body into said recess in said rear lobe across substantially the complete extent of said recess in the rear lobe across the width of said body.

4. A pillow kit comprising:

a compressible and resilient cushion body having a top and a bottom, a recess therein extending across the width of said body, and a narrow opening extending from the outside of said body into said recess along substantially the complete extent of said recess across the width of said body;

a set of compressible and resilient inserts shaped and dimensioned for snug reception one at a time in said recess, each of said inserts having a predetermined compressibility different from every other insert in said set;

said cushion body having a trough in said top, a rounded front lobe in front of said trough, and a rounded rear lobe behind said trough;

said recess in said cushion body being in said front lobe;

said rear lobe having a recess therein extending across the width of said cushion body and shaped and dimensioned to snugly receive said inserts one at a time;

said cushion body having a narrow opening therein extending from the outside of said body into said recess in said rear lobe across substantially the complete extent of said recess in the rear lobe across the width of said body;

and a compressible and resilient top piece substantially filling said trough and removably received therein.

5. A pillow kit comprising:

a compressible and resilient cushion body having a top and a bottom, a back edge, a rounded front lobe with a recess therein extending across the width of said body, and a narrow opening extending from the outside of said body into said recess along substantially the complete extent of said recess across the width of said body;

a set of compressible and resilient inserts shaped and dimensioned for snug reception one at a time in said recess, each of said inserts having a predetermined compressibility different from every other insert in said set;

and a compressible and resilient top piece adhesively bonded to said top of said cushion body behind said front lobe, said top piece having a plurality of upwardly projecting rounded protrusions on the top;

said top piece extending across the top of said cushion body from said front lobe to said back edge of the cushion body.

6. A pillow kit comprising:

a compressible and resilient cushion body having a top and a bottom, a recess therein extending across the width of said body, and a narrow opening extending from the outside of said body into said recess along substantially the complete extent of said recess across the width of said body;

a set of compressible and resilient inserts shaped and dimensioned for snug reception one at a time in said recess, each of said inserts having a predetermined compressibility different from every other insert in said set, said cushion body having:

a bottom segment below said recess;

a top segment above said recess;

a front wall projecting convexly in front of said recess between said bottom and top segments;

a lower rear segment extending up from said bottom segment behind said recess to the bottom of said narrow opening in the cushion body;

and an upper rear segment extending down from said top segment behind said recess to the top of said narrow opening in the cushion body.

7. A pillow kit according to claim 6 wherein:

said recess in the pillow body is substantially oval in vertical cross-section.

* * * * *